US007278464B2

(12) United States Patent
Vincent

(10) Patent No.: US 7,278,464 B2
(45) **Date of Patent: *Oct. 9, 2007**

(54) CONTROL PIN

(75) Inventor: Mark Vincent, Leighton Buzzard (GB)

(73) Assignee: Pyrotek Incorporated, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/410,444

(22) Filed: Apr. 26, 2006

(65) Prior Publication Data

US 2006/0283570 A1 Dec. 21, 2006

(30) Foreign Application Priority Data

Jun. 16, 2005 (GB) ..... 0512285.8

(51) Int. Cl.
*B22D 11/10* (2006.01)

(52) U.S. Cl. ..... 164/437; 164/337

(58) Field of Classification Search ..... 164/437, 164/337, 133

See application file for complete search history.

(56) References Cited

U.S. PATENT DOCUMENTS

| | | | | |
|---|---|---|---|---|
| 3,111,732 A | | 11/1963 | Schroer et al. | |
| 4,520,861 A | * | 6/1985 | Sobolewski et al. | 164/473 |
| 5,880,046 A | | 3/1999 | Delvaux et al. | |
| 6,481,489 B1 | * | 11/2002 | Jones | 164/316 |
| 7,165,757 B2 | * | 1/2007 | Vincent | 251/318 |
| 2002/0117253 A1 | | 8/2002 | Hanse | |

FOREIGN PATENT DOCUMENTS

| | | |
|---|---|---|
| EP | 1 525 936 A | 4/2005 |
| GB | 2407287 A | 4/2005 |
| JP | 03-198959 A | 8/1991 |
| JP | 03198957 A | 8/1991 |
| JP | 03198960 A | 8/1991 |

* cited by examiner

*Primary Examiner*—Kevin Kerns
*Assistant Examiner*—I.-H. Lin
(74) *Attorney, Agent, or Firm*—Knobbe Martens Olson & Bear LLP

(57) ABSTRACT

A control pin for controlling the flow of liquid metal in a casting process includes an elongate body member, the body member being made at least partially of a composite ceramic material that includes a fibrous reinforcing material embedded within a ceramic matrix, and a failsafe element embedded within the composite ceramic material.

27 Claims, 10 Drawing Sheets

CONTROL PIN

CROSS-REFERENCE TO RELATED APPLICATIONS

This application claims priority under 35 U.S.C. § 119 (a)-(d) to Great Britain Patent Application No. 0512285.8, filed Jun. 16, 2005, the entire contents of which are incorporated herein by reference.

FIELD OF THE INVENTION

The present invention relates to a control pin for controlling the flow of liquid metal in a casting process. In particular, but not exclusively, it relates to a control pin for controlling the flow of nonferrous liquid metals such as aluminium and zinc.

BACKGROUND OF THE INVENTION

A typical metal casting process is described in U.S. Pat. No. 3,111,732. In that process, liquid metal is poured through a spout (or "underpour outlet") into a mould, where the metal freezes to form a billet or slab. The flow of metal through the spout is controlled by a control pin (or "flow regulator") that is located within the spout. The control pin may be raised to increase the rate of flow of metal through the spout, or lowered to decrease or interrupt the flow of metal.

Control pins are generally made of a refractory material, which is able to withstand the high temperature of the molten metal. The material must also be hard so as to resist wear on the end of the rod, where it presses against the seat in the spout. One of the most commonly used materials is dense fused silica (DFS). This material is quite tough and has good thermal shock characteristics, but silica is wetted and attacked by liquid aluminium and control pins made of this material therefore have to be provided with a non-stick protective coating, for example of boron nitride. This coating has to be reapplied frequently (for example every one or two pouring operations) and such pins therefore have a high maintenance requirement.

Another disadvantage with control pins made of DFS is that they tend to have a high heat capacity and have to be pre-heated prior to commencement of the metal pouring operation, to bring them up to or close to the temperature of the molten metal. This adds considerably to the complexity of the pouring operation and gives rise to the risk of a serious accident when transferring the hot control pin from the pre-heating oven to the spout. If the control pin is not pre-heated, the molten metal can solidify upon contact with the control pin, thus blocking the spout.

Our earlier patent application EP1525936 describes a control pin for controlling the flow of liquid metal in a casting process, which includes an elongate body member and a wear-resistant tip at one end of the elongate body member, the body member being made at least partially of a laminated composite ceramic material that includes multiple layers of a reinforcing fabric embedded within a cast ceramic matrix. The control pin resolves most of the disadvantages set out above and has proved to be extremely durable, having a designed service lifetime of approximately 40 drops, as compared to a lifetime of typically just 15 drops for a control pin made of DFS.

This very long lifetime has, however, led some users to ignore the designed service lifetime and use the control pin for much longer, for example for 60 or more drops. Repeated exposure to the high temperature of the liquid aluminium can cause carbonisation and degradation of the reinforcing fabric, eventually causing the control pin to break. The broken part of the control pin can then block the pouring spout, causing serious operational difficulties. The present invention provides a control pin that mitigates at least some of the aforesaid disadvantages.

SUMMARY OF THE INVENTION

According to the present invention, there is provided a control pin for controlling the flow of liquid metal in a casting process, the control pin including an elongate body member and a wear-resistant tip at one end of the elongate body member, the body member being made at least partially of a laminated composite ceramic material that includes multiple layers of a reinforcing fabric embedded within a cast ceramic matrix. In particular, but not exclusively, the invention relates to a control pin for controlling the flow of nonferrous liquid metals such as aluminium and zinc, and a failsafe element embedded within the composite ceramic material.

A control pin made of a laminated composite ceramic material is extremely tough owing to the presence of the reinforcing fabric, which prevents cracks propagating through the material. Breakage of the control pin and blocking of the pouring spout is therefore prevented throughout the normal designed lifespan of the control pin. If, after excessive usage and degradation of the reinforcing fabric, the control pin does break, the failsafe element holds the broken parts together, allowing the control pin to be safely withdrawn and replaced.

The control pin includes a wear-resistant tip at the lower end of the elongate body member, to reduce erosion by the liquid metal and wear from contact with the spout.

The composite ceramic material also has good thermal shock characteristics and is not wetted or attacked by liquid aluminium. A control pin made of this material therefore has a long life and a low maintenance requirement.

A control pin made of the composite ceramic material can also have a low heat capacity and so does not have to be pre-heated prior to commencement of the metal pouring operation. This greatly simplifies the pouring operation and provides substantial cost savings and safety benefits.

Advantageously, the failsafe element extends along substantially the whole length of the elongate body member.

The failsafe element is preferably made of a material that is resistant to high temperatures and/or to oxidation.

The failsafe element is preferably made of a metallic material, and may consist of a metallic wire. The failsafe element may for example comprise a helical element or a mesh.

Preferably, the failsafe element is embedded between layers of the reinforcing fabric.

Advantageously, the reinforcing fabric comprises a woven fabric, preferably made of glass.

The composite ceramic material may include between two and 25 layers, and preferably between 4 and 10 layers, of reinforcing fabric.

The matrix material may be selected from a group comprising fused silica, alumina, mullite, silicon carbide, silicon nitride, silicon aluminium oxy-nitride, zircon, magnesia, zirconia, graphite, calcium silicate, boron nitride (solid BN), aluminium nitride (AlN) and titanium diboride ($TiB_2$), and mixtures of these materials. The matrix material is preferably calcium based and may include calcium silicate and silica. More preferably, the matrix material includes Wollastonite and colloidal silica.

Advantageously, the control pin includes a non-stick surface coating, which may include boron nitride, to reduce wetting by the liquid metal and reduce or prevent the depositing of a skin or skull of metal on the surface of the control pin. Although the provision of a non-stick coating is preferred, that coating does not have to be reapplied as frequently as with control pins made of other some materials such as DFS, since the composite ceramic material of the pin body is naturally non-wetted.

The control may be substantially cylindrical and is preferably constructed and arranged to be suspended substantially vertically in use. The control pin may have a suspension point at its upper end and a seating at its lower end.

The elongate body member is preferably at least partially hollow. This reduces the heat capacity of the pin, so that it heats rapidly on contact with the liquid metal, without causing the metal to freeze. It is particularly advantageous for the lower portion of the control pin, which is immersed in the liquid metal, to be hollow. The elongate body member may include a circumferential wall having a wall thickness in the range 1-10 mm, preferably approximately 5 mm, to provide a low heat capacity.

The wear-resistant tip is preferably inserted at least partially into one end of the elongate body member.

Advantageously, the elongate body member and the wear-resistant tip have complementary locking formations. The complementary locking formations may include complementary recesses on the elongate body member and the wear-resistant tip, which are filled with an adhesive or cement.

The wear-resistant tip may be made of a ceramic material, and preferably from a material selected from a group comprising fused silica, alumina, mullite, silicon carbide, silicon nitride, silicon aluminium oxy-nitride, zircon, magnesia, zirconia, graphite, calcium silicate, boron nitride, aluminium titanate, aluminium nitride and titanium diboride. Preferably, the tip is made of a non-wetting material with a low coefficient thermal expansion, for example a cement-bonded fused silica refractory. Advantageously, the wear-resistant tip is made from a material having a density in the range 1800-3000 kg/m$^3$, preferably 1900-2500 kg/m$^3$.

Advantageously, the control pin has a length in the range 200-1000 mm (typically 750 mm) and a diameter in the range 20-75 mm (typically 40 mm).

Various embodiments of the present invention will now be described, by way of example, with reference to the accompanying drawings.

DETAILED DESCRIPTION OF THE PREFERRED EMBODIMENT

Figure 1:
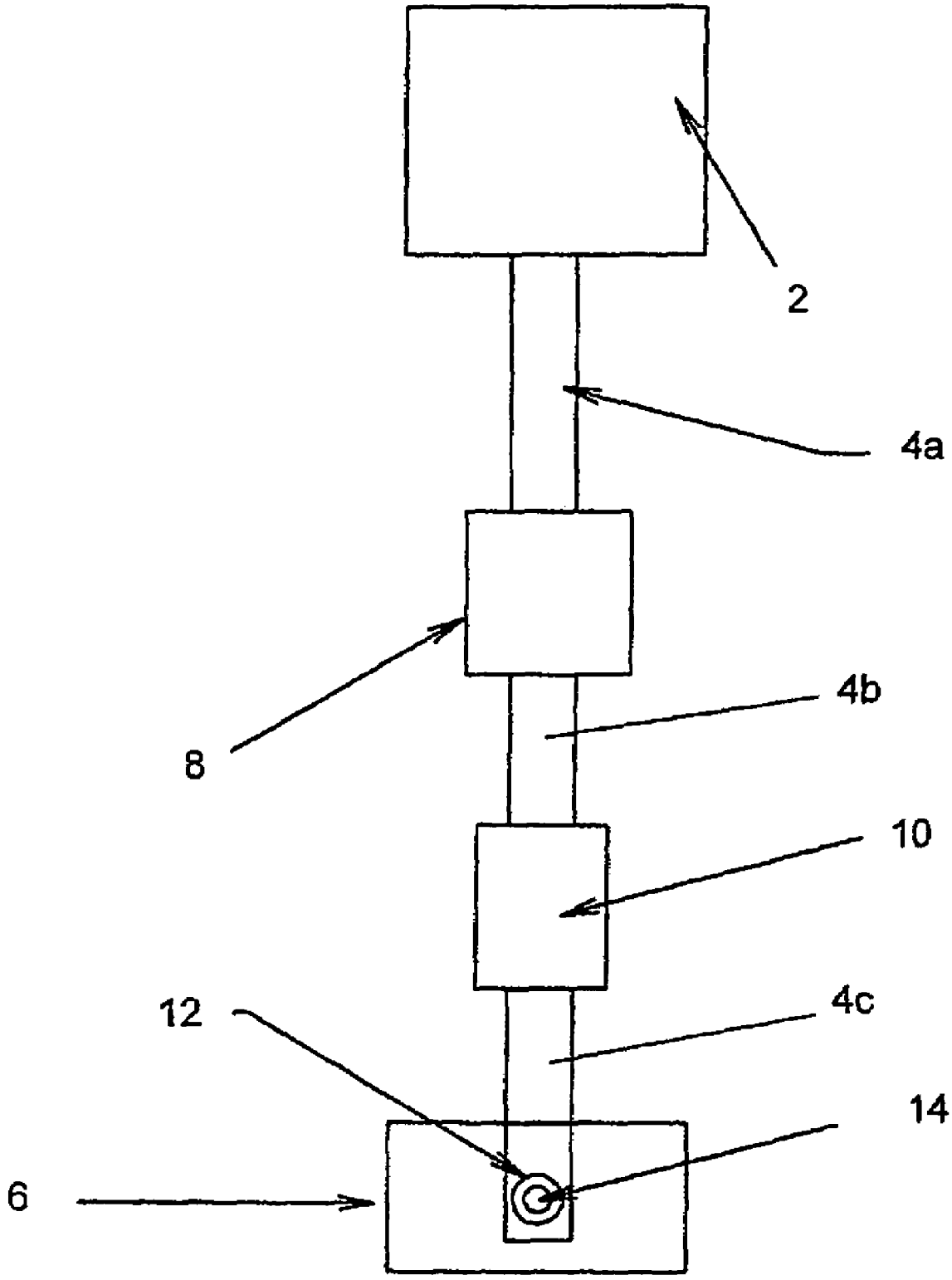
FIG. 1 is a plan view showing schematically the main components of a typical aluminium casting installation.

A typical aluminium casting installation is shown schematically in FIG. 1 and includes a furnace 2, from which molten metal flows through a set of launders 4*a*, 4*b*, 4*c* (or troughs) to a mould 6, which may for example be a direct chill mould. Between the furnace 2 and the mould 6 various additional metal processing units may be provided including, for example, a degassing unit 8 and a filter unit 10. Metal flows from the last launder 4*c* into the mould 6 through a down spout 12, the flow through the spout being controlled by a control pin 14.

Figure 2:
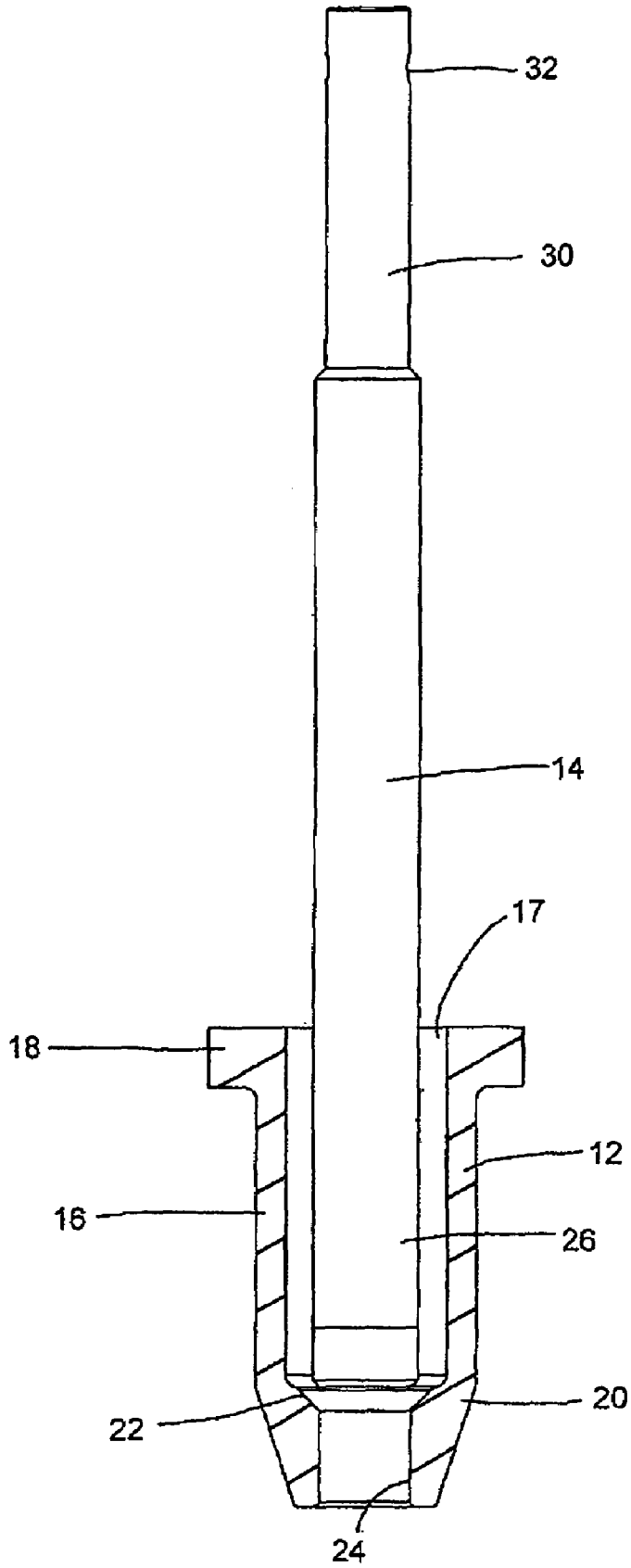
FIG. 2 is a side elevation of a control pin located in an operational position within a first kind of pouring spout (the pouring spout being shown in side section)

The down spout 12 and the associated control pin 14 are shown in more detail in FIG. 2. The down spout 12 is made of a refractory material such as dense fused silica (DFS) and is conventional in design. The spout is tubular, having a cylindrical wall 16 with an axial bore 17 and an outwardly extending flange 18 at its upper end. The lower part 20 of the spout has a frusto-conical external shape and internally has a frusto-conical seat 22, leading to a reduced diameter cylindrical bore 24. In use, the spout 12 is mounted in the bottom of a launder 4*c*, so that molten metal within the launder can flow out through the spout.

The control pin 14 is substantially cylindrical in shape, and in use is suspended vertically so that its lower end 26 is located within the cylindrical body 16 of the outlet spout 12. The edge 28 at the lower end of the control pin is bevelled to provide a seal when located against the seat 22 in the spout. The upper part 30 of the control pin is of a slightly reduced diameter, and includes a horizontal mounting bore 32 from which the pin is suspended.

Figure 3:
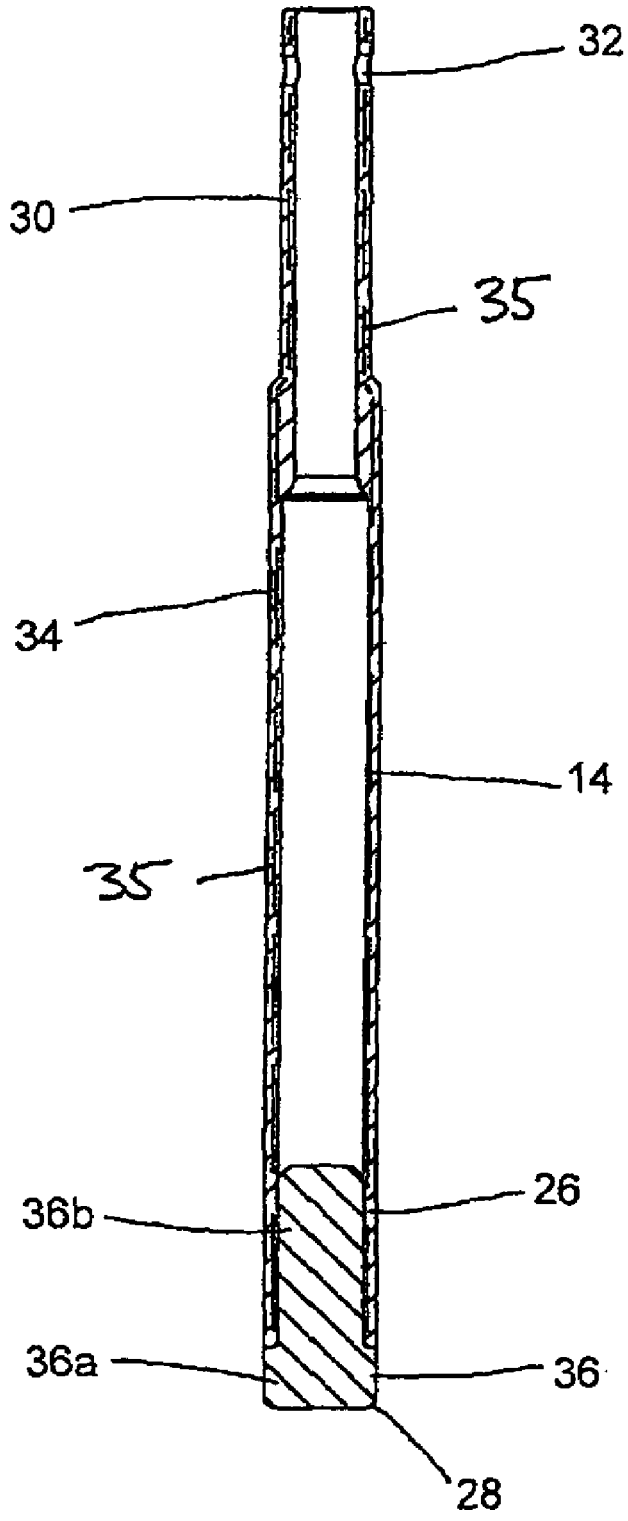
FIG. 3 is a side sectional view of the control pin shown in FIG. 2.

As shown in FIG. 3, the control pin 14 includes a hollow tubular body member 34 having a hard wear-resistant tip 36 at its lower end. The tip 36 has a head 36*a* that protrudes beyond the end of the tubular body 34, and a body portion 36*b* that is cemented or otherwise secured within the lower end 26 of the control pin 14.

The tubular body 34 of the control pin 14 is made of a composite ceramic material that includes numerous layers of a woven fibre reinforcing fabric embedded in a ceramic matrix, and a failsafe element 35 for example of stainless steel or another suitable material that is embedded within the composite ceramic material.

The woven fibre reinforcing fabric is preferably made of woven glass. Various materials may be used for the ceramic matrix, including fused silica, alumina, mullite, silicon carbide, silicon nitride, silicon aluminium oxy-nitride, zircon, magnesia, zirconia, graphite, calcium silicate, boron nitride, aluminium nitride and titanium diboride, or a mixture of these materials. Preferably, the ceramic matrix includes calcium silicate (Wollastonite) and silica and comprises a mouldable refractory composition as described in U.S. Pat. No. 5,880,046, which is sold by Pyrotek, Inc. under the trademark RFM.

In a preferred embodiment, the ceramic matrix is made from a composition consisting essentially of 8% to 25% by weight of an aqueous phosphoric acid solution having a concentration of phosphoric acid ranging from 40% to 85% by weight, said phosphoric acid having up to 50% of its primary acidic functions neutralized by reaction with vermiculite; and 75% to 92% by weight of a mixture containing wollastonite and an aqueous suspension containing from 20% to about 40% by weight of colloidal silica, wherein the mixture has a weight ratio of said aqueous suspension to said wollastonite ranging from 0.5 to 1.2.

The tubular body 34 of the control pin 14 preferably has between 2 and 25 layers of the reinforcing fabric, typically approximately 4 to 10 layers.

The tip 36 is preferably made of a hard, wear-resistant material that resists erosion from the liquid metal and wear from contact with the spout 12. The material also preferably has good resistance to thermal shock, a low density (approx. 1900-2500 kg/m$^3$) and a low coefficient of thermal expansion (approx. 0.7-1.0×10$^{-6}$ mm/mm/° C.). More particularly, the density and thermal expansion values should be similar to those of the matrix material, so that they are well matched. The tip 36 may be manufactured from a ceramic material, for example a fused silica refractory, dense fused silica (DFS), alumina, mullite, silicon carbide, silicon nitride, zircon, magnesia, zirconia, graphite, calcium silicate, boron nitride (solid BN), aluminium titanate, aluminium nitride (AlN), titanium diboride ($TiB_2$) or silicon aluminium oxynitride (Sialon).

A particularly preferred material for the wear-resistant tip 36 is a fused silica refractory such as that sold by Pyrotek Inc. under the trademark Pyrocast XL, which in addition to a fused silica aggregate also includes other ingredients such as non-wetting agents and cement. This material provides a number of significant performance advantages, including high resistance to thermal shock, high erosion resistance, good dimensional stability, easy cleaning and non-wetting properties.

The important physical characteristics of some of the above-mentioned materials are shown below in Table 1, together with the comparative characteristics of the preferred composite ceramic material, Pyrotek RFM™.

TABLE 1

| Material | Pyrotek Trademark | Density kg/m$^3$ | Thermal expansion coefficient mm/mm/° C. × 10$^{-6}$ | Max. service temperaure ° C. |
|---|---|---|---|---|
| Composite ceramic | RFM | 1600 | 0.9 | 1100 |
| Fused silica refractory | Pyrocast XL | 1900–1950 | 0.82 | 1000 |
| Dense fused silica | Pyrocast DFS | 1760–1950 | 0.5–0.7 | 1650 |
| Silicon carbide | Pyrocast XL-SC | 2563 | 4.9 | 1200 |
| Alumina | Pyrocast AL2 | 2565 | 5.7 | 1650 |
| Silicon aluminium oxynitride | O'-Sialon | 2620 | 3.9 | 1500 |

The failsafe element 35 may take various forms, some examples being shown in FIGS. 4 to 7.

Figure 4:
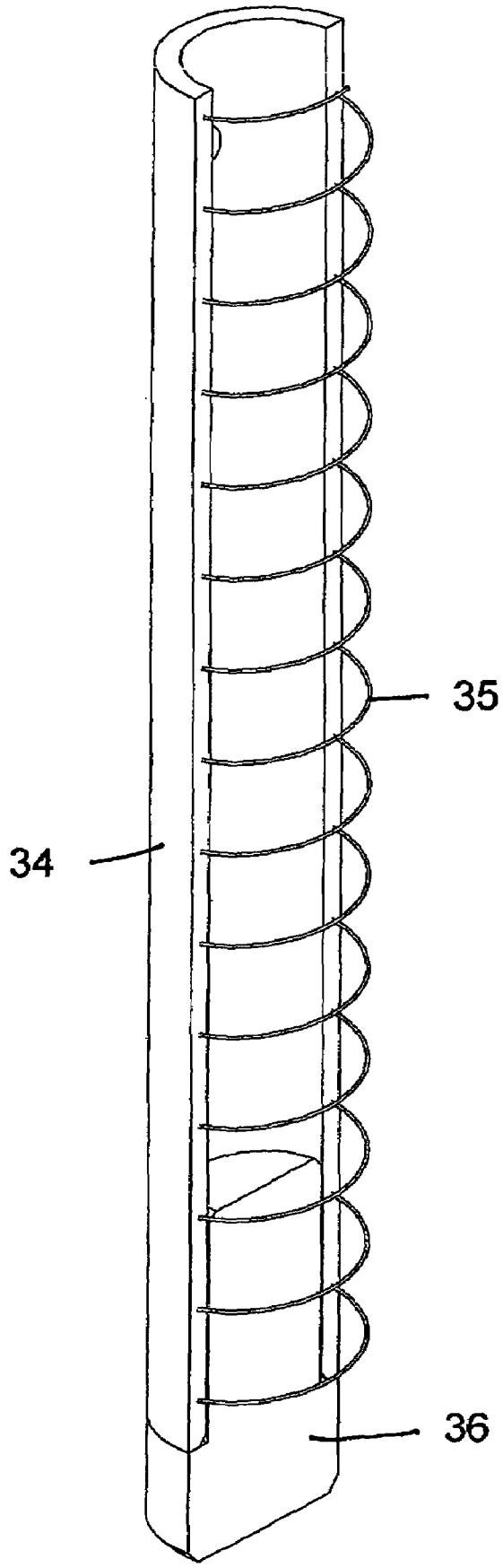
FIG. 4 is part-sectional side view of a control pin, showing an embedded failsafe element.
Figure 5:
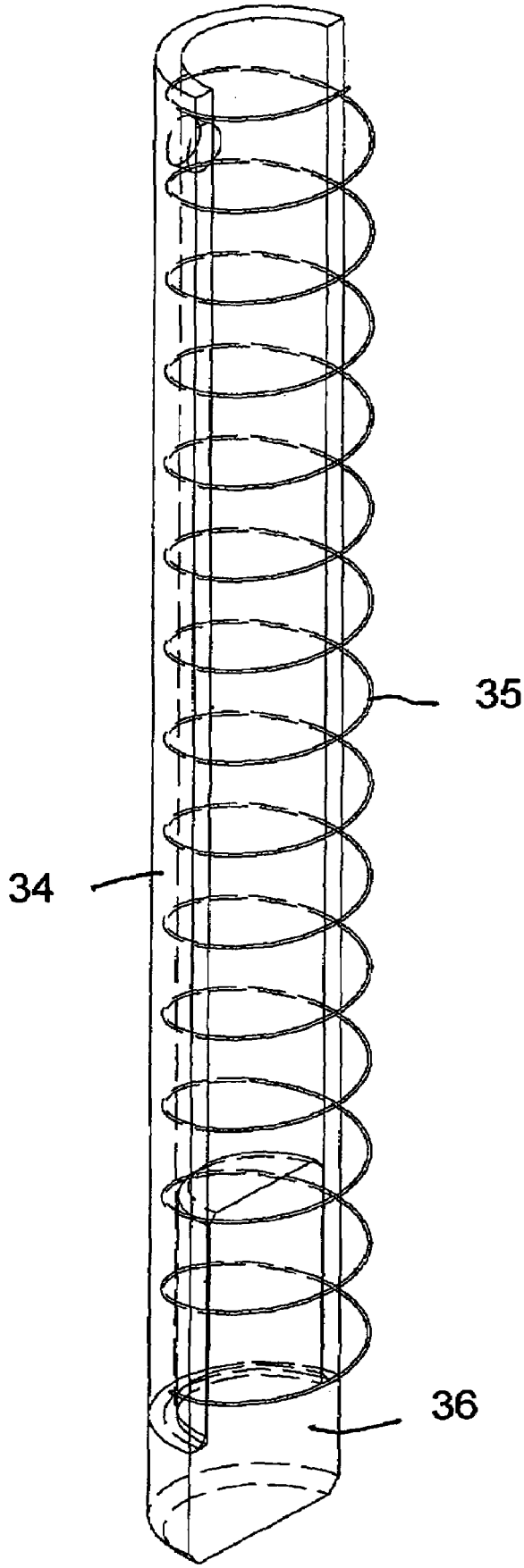
FIG. 5 is another part-sectional side view of the control pin shown in FIG. 4, showing some hidden details.

In the first example shown in FIGS. 4 and 5, the failsafe element 35 comprises a metallic wire, which extends helically along substantially the whole length of the tubular body 34. The helical wire is embedded within the cylindrical wall of the tubular body 34, between layers of the reinforcing fabric, to provide a strong interlock with the composite ceramic material.

Figure 6:
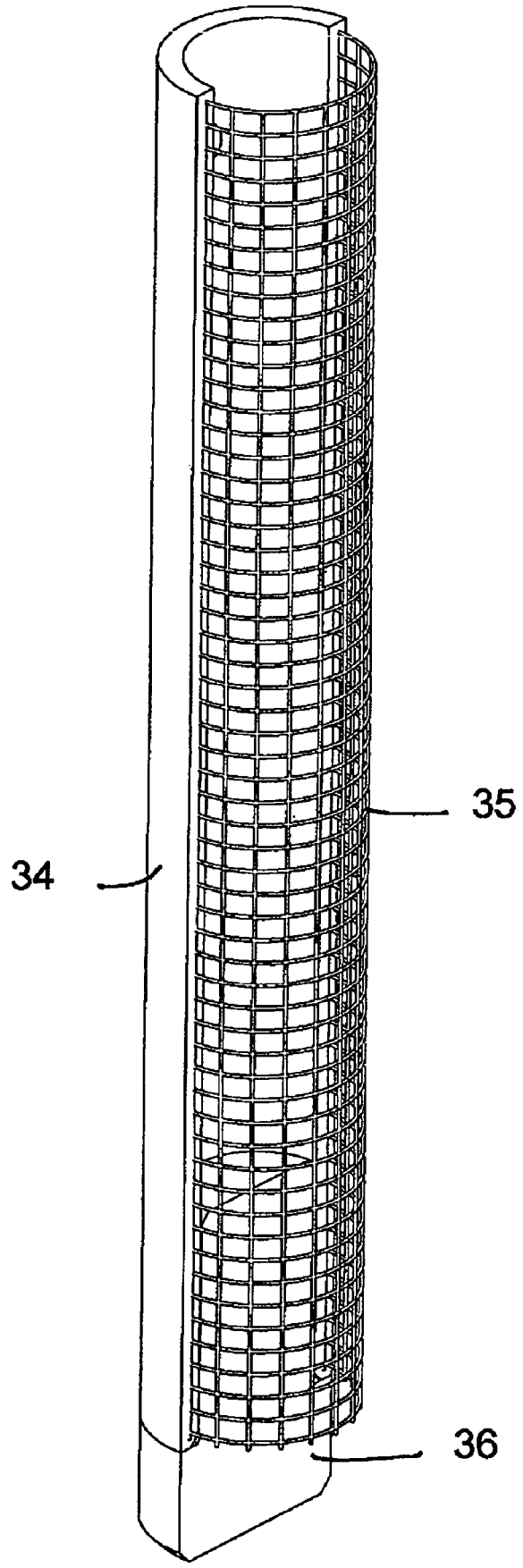
FIG. 6 is part-sectional side view of a second control pin, showing an alternative embedded failsafe element.
Figure 7:
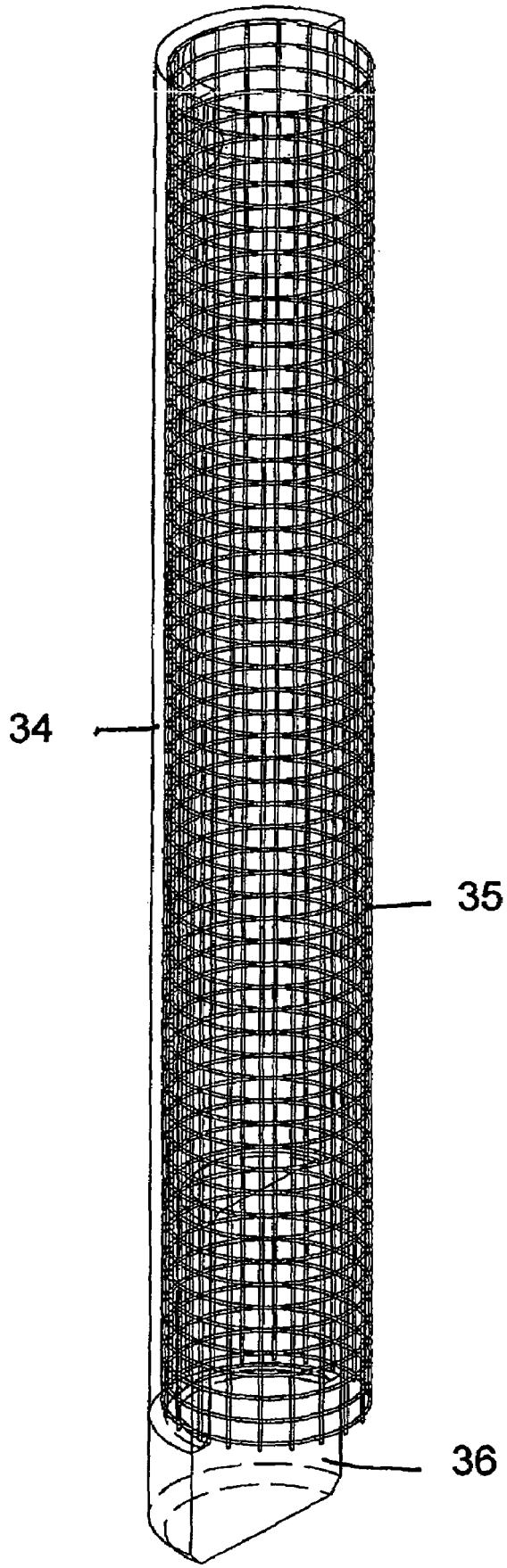
FIG. 7 is another part-sectional side view of the control pin shown in FIG. 6, showing some hidden details.

In the second example shown in FIGS. 6 and 7, the failsafe element 35 comprises a mesh of metallic wire, which is bent into a cylinder and embedded within the cylindrical wall of the tubular body 34. The wire mesh extends along substantially the whole length of the tubular body 34 and is embedded between layers of the reinforcing fabric, to provide a strong interlock with the composite ceramic material.

Figure 8:
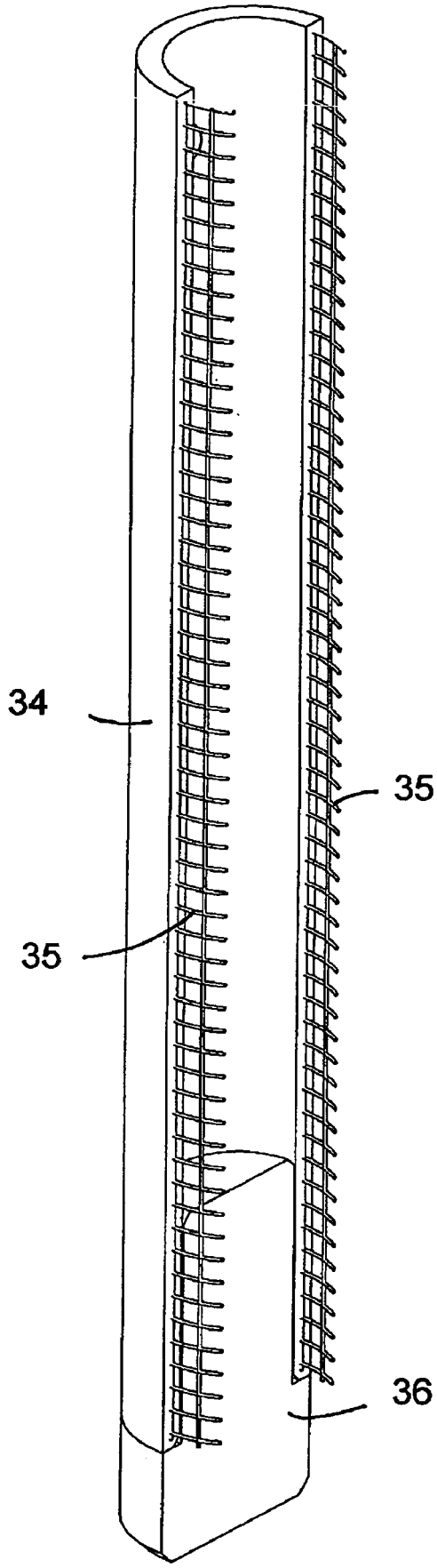
FIG. 8 is part-sectional side view of a third control pin, showing another alternative embedded failsafe element.

In the third example shown in FIG. 8, the failsafe element 35 comprises two elongate strips of metallic wire mesh, which are embedded within the cylindrical wall on diametrically opposed sides of the tubular body 34. The strips of wire mesh extend along substantially the whole length of the tubular body 34 and are embedded between layers of the reinforcing fabric, to provide a strong interlock with the composite ceramic material.

The failsafe element may of course take various other forms, including straight wires, multiple wires, nets and so on.

The failsafe element may be made of any suitable material that can withstand the high temperature of the liquid aluminium (approximately 700° C.) and has sufficient strength to prevent separation of the control pin if it breaks. The material should also be resistant to oxidation, owing to the fact that the composite ceramic material is porous therefore air permeable. Various materials are suitable including in particular a number of metal alloys. These materials include but are not limited to the following:

Haynes 214 (Ni 75%, Cr 16%, Al 4.5%, Fe 3%)
Inconel 600, 601, 625, 718, X750
Incoloy 800, 800HT, 825, A286
Nimonic, 90, 80A, 75
Monel 400, K500
Hastelloy B-2, B-3, C-4, C-22, C-276, C-2000, G-30, X
Haynes 25, 214
Nickel 200, 201, 205, 212, 270
Ni-Span-C 902
Nilo 36, 42, 48, 52, K
Phynox
MP35N
RENE 41
Alloy 20 CB 3
Titanium Grade 1, 5
Stainless Steel 302, 304, 316, 316LVM, DTD189A Preferably, the control pin 14 is provided with a non-stick coating, for example of boron nitride, to enhance its non-wetting properties.

The dimensions of the spout 12 and the control pin 14 may of course be varied according to the capacity of the casting installation. Usually, the control pin 14 will have a length of approximately 200-1000 mm (typically 750 mm) and a diameter of 20-75 mm (typically 40 mm). The wall thickness of the tubular body 34 will normally be between 1 and 10 mm, a thickness of 5 mm being typical.

Figure 9:
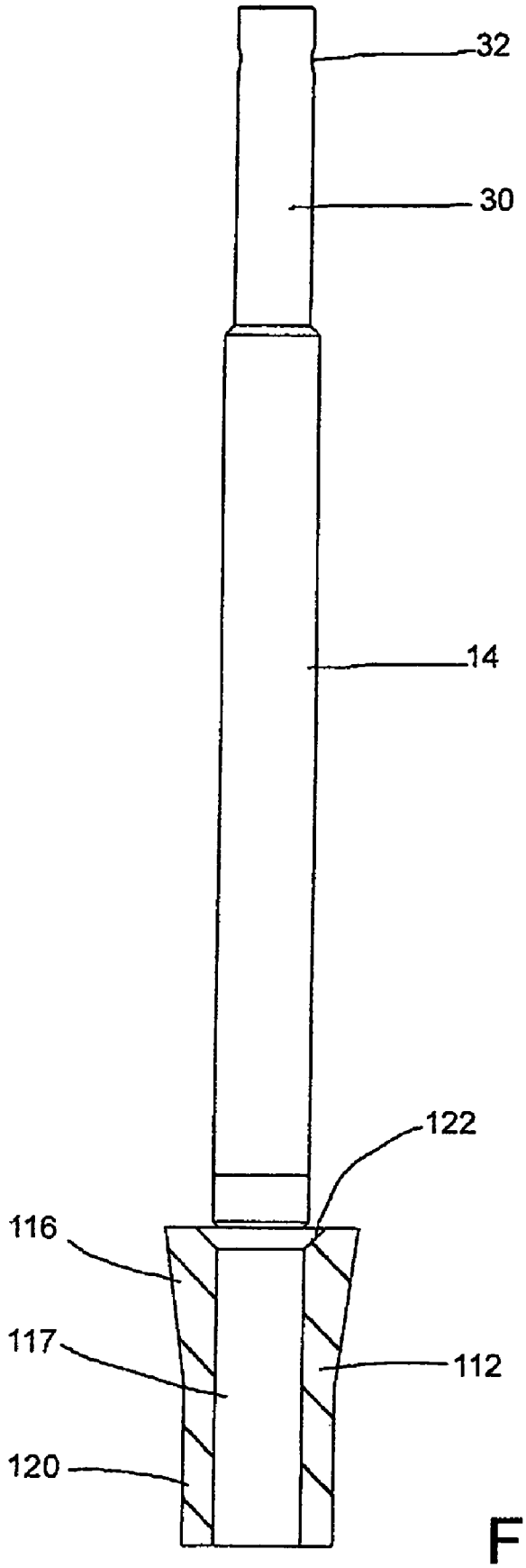
FIG. 9 is a side elevation of a control pin located in an operational position above a second kind of pouring spout (the pouring spout again being shown in side section)

In the apparatus shown in FIG. 9, the control pin 14 is identical to that shown in FIGS. 2 and 3. The outlet spout 112 is of a different design, having a frusto-conical seat 122 at its upper end, above a cylindrical bore 117. The external wall of the spout 112 includes an upper part 116 that is frusto-conical in shape, and a lower cylindrical part 120. The control pin may be seated against the seat 122 to interrupt the flow of liquid metal, or raised to allow a controlled flow of metal through the spout.

Because the upper tubular part of the control pin 14 is made of a laminated composite material, including a woven fibre reinforcing fabric, it is extremely strong and tough. Even if small cracks develop in the ceramic matrix material, these do not generally propagate owing to the presence of the woven glass reinforcing fabric.

Eventually, after many pouring operations have been completed, the woven fibre reinforcing fabric may have become degraded by exposure to the high temperature of the liquid aluminium to such an extent that the body of control pin cracks. In this event, the failsafe element holds the broken parts of the control pin together, so that it may be safely removed and replaced with a new control pin 14.

The control pin 14 has a low heat capacity, owing to the fact that the tubular body 34 is hollow and has a low mass. Although the tip 36 is solid, it is largely insulated by the surrounding wall of the tubular body 34 and, being relatively small and of low mass, it also has a low heat capacity. The control pin 14 therefore draws very little heat from the molten metal flowing through the spout 12, with the result that it is not generally necessary to preheat the control pin 14 prior to pouring.

The ceramic matrix material is not wetted by the molten aluminium and, although the provision of a non-stick coating (e.g. Boron Nitride) is preferred, this can be applied much less often than is necessary with control pins made of some other materials, such as DFS.

The ceramic tip 36 is very hard wearing, and therefore provides a good seal against the seat of the spout, even after many uses.

A method of manufacturing the control pin will now be described. First, the ceramic matrix material is made up by blending together the components of that material, for example as described in U.S. Pat. No. 5,880,046. The component materials may, for example, consist of approximately 60% by wt Wollastonite and 40% by wt solid colloidal silica. These materials are blended together to form a slurry.

The hollow body 34 of the control pin 14 is then constructed in a series of layers on a mandrel, by laying precut grades of woven E-glass cloth onto the mandrel and adding the slurry, working it into the cloth to ensure full wetting of the fabric. This is repeated to build up successive layers of cloth and matrix material, until the desired thickness is achieved. At an intermediate point during the process of building up the layers, the failsafe element is incorporated, either by winding the element helically onto the body of the control pin or, in the case of a mesh, by wrapping the mesh around the body. Further layers of cloth and matrix material are then applied, so that the failsafe element is embedded between layers of the reinforcing fabric. Each layer of reinforcing fabric typically has a thickness of approximately 1 mm and the control pin shown in FIGS. 2 and 3 would typically have approximately five layers of the glass reinforcing fabric.

Once the product has achieved the desired thickness, it is machined in green (unfired) form to shape the outer surface of the tubular body 34. The tubular body 34 is then removed from the mandrel and placed in a furnace to dry. After drying, the ceramic tip 36 is inserted and glued into place using a suitable adhesive. The control pin is then subjected to final finishing and fettering processes, and a non-stick coating, for example of boron nitride, is applied.

Although control pins of numerous different lengths are required by different foundries, we have found that in practice the tubular body 34 of the control pin 14 can be made up in advance to a limited number of standard lengths, and these tubular bodies can then be cut to length as required. After cutting, a ceramic tip 36 of the appropriate diameter is inserted into the open end of the tubular body 34 and glued in place with a suitable adhesive. A non-stick coating of boron nitride can then be applied to the complete pin 14. This method of production allows the tubular bodies 34 to be mass produced in advance and held in stock until required, thereby significantly reducing both the manufacturing and storage costs.

Figure 11:
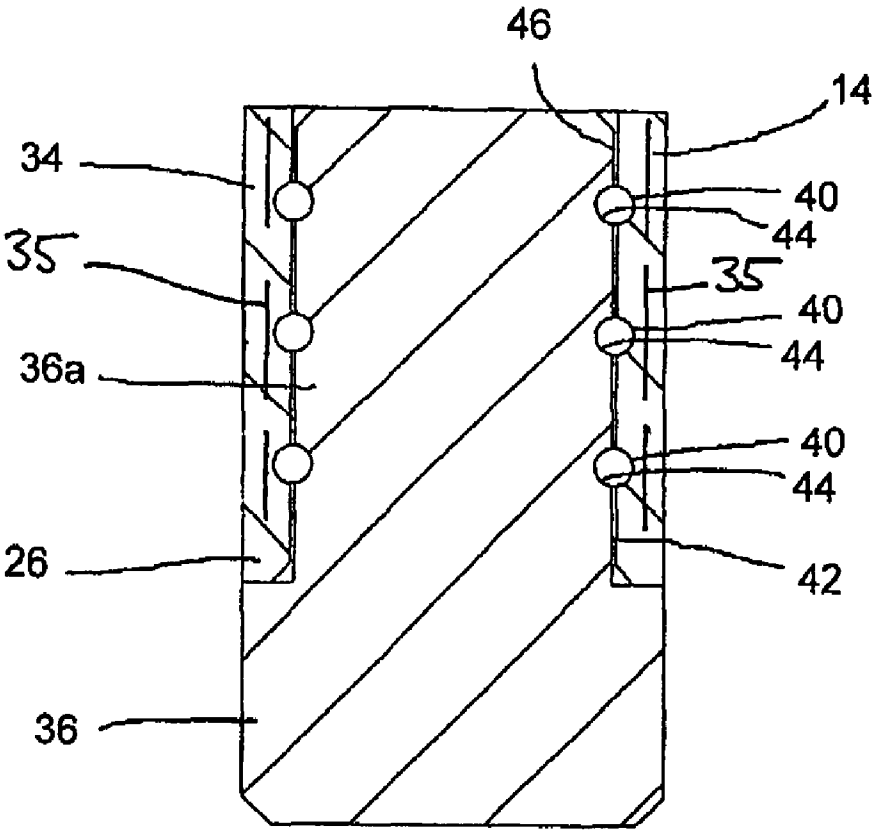
FIG. 11 is a side-section on line A-A of FIG. 10.
Figure 10:
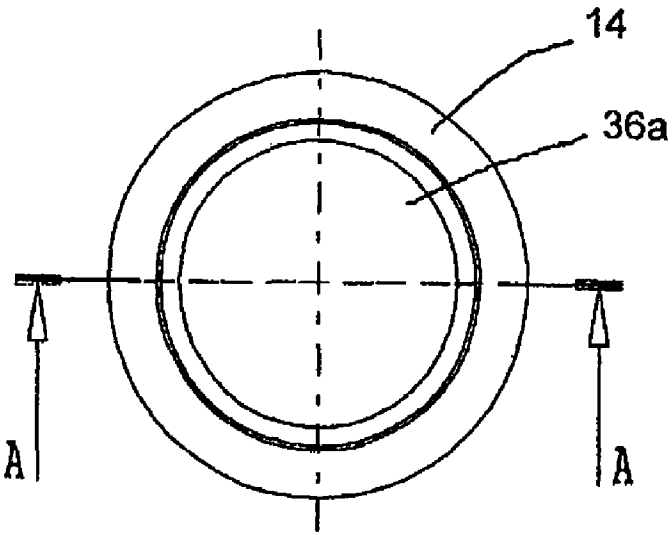
FIG. 10 is a cross-section through a modified control pin.

A modified form of the control pin 14 and the wear resistant tip 36 is shown in FIGS. 10 and 11. The control pin 14 has three annular grooves 40, which are provided on the internal surface 42 of the tubular body 34 towards the lower end 26 of the control pin (only the lower end of the pin being shown). Each of these grooves 40 has a semi-circular cross-section. Three more annular grooves 44, also semi-circular in cross-section, are formed on the external surface of the body portion 36*a* of the wear-resistant tip 36. The two sets of grooves 40,44 are complementary to one another and are designed so that when the tip 36 is fully inserted into the end of the hollow control pin 14 they are aligned, forming three annular channels of circular cross-section. When the tip 36 is glued into place, the glue fills these channels, forming a mechanical lock that prevents removal of the tip 36 from the control pin 14.

Various other modifications of the invention are possible, some of which will now be described.

The ceramic tip 36 may be attached to the tubular body 34 in a number of different ways, for example by means of an adhesive, or complementary screw threads on the tip and the body, or by a locking pin that extends through complementary apertures in the tip and the body. Alternatively, the tubular body 34 may be cast in situ around the ceramic tip 36, the enclosed part of the tip having locking formations to prevent any separation of the two parts. It is also possible to provide a removable tip, secured for example by means of complementary screw threads, so that it can be replaced in the event of excessive wear or damage.

Although it is preferred that the whole of the body 34 is tubular, it may alternatively be solid or only partially tubular, and the tubular part may if desired be filled with another material. Further, although it is preferred that the whole of the body 34 is made of the same composite ceramic material, parts of the body may be made of other materials. For example, the upper part of the control pin, which does not come into contact the liquid metal, may be made of a wide variety of materials.

The invention claimed is:

1. A control pin that controls the flow of liquid metal in a casting process, the control pin comprising an elongate body member and a wear-resistant tip at one end of the elongate body member, the body member being made at least partially of a laminated composite ceramic material that includes multiple layers of a reinforcing fabric embedded within a cast ceramic matrix, and a failsafe element embedded within the composite ceramic material.

2. A control pin according to claim 1, wherein the failsafe element extends along substantially the whole length of the elongate body member.

3. A control pin according to claim 1, wherein the failsafe element is made of a material that is resistant to high temperatures.

4. A control pin according to claim 1, wherein the failsafe element is made of a material that is resistant to oxidation.

5. A control pin according to claim 1, wherein the failsafe element is made of a metallic material.

6. A control pin according to claim 1, wherein the failsafe element comprises a metallic wire.

7. A control pin according to claim 1, wherein the failsafe element comprises a helical element.

8. A control pin according to claim 1, wherein the failsafe element comprises a mesh.

9. A control pin according to claim 1, wherein the failsafe element is embedded between layers of the reinforcing fabric.

10. A control pin according to claim 1, wherein the reinforcing fabric comprises a woven reinforcing fabric.

11. A control pin according to claim 1, wherein the reinforcing fabric is made of glass.

12. A control pin according to claim 1, wherein the matrix material is selected from the group consisting of fused silica, alumina, mullite, silicon carbide, silicon nitride, silicon aluminium oxy-nitride, zircon, magnesia, zirconia, graphite, calcium silicate, boron nitride, aluminium nitride, titanium diboride, and mixtures thereof.

13. A control pin according to claim 1, wherein the matrix material is calcium based.

14. A control pin according to claim 1, wherein the matrix material comprises calcium silicate and silica.

15. A control pin according to claim 1, wherein the matrix material comprises Wollastonite and colloidal silica.

16. A control pin according to claim 1, wherein the control pin comprises a non-stick surface coating.

17. A control pin according to claim 16, wherein the coating comprises boron nitride.

18. A control pin according to claim 1, wherein the elongate body member is substantially cylindrical.

19. A control pin according to claim 1, wherein the elongate body member is at least partially hollow.

20. A control pin according to claim 19, wherein the elongate body member comprises a circumferential wall having a wall thickness from 1-10 mm.

21. A control pin according to claim 1, wherein the wear-resistant tip is inserted at least partially into one end of the elongate body member.

22. A control pin according to claim 1, wherein the wear-resistant tip is made of a ceramic material.

23. A control pin according to claim 22, wherein the wear-resistant tip is made of a material selected from the group consisting of fused silica, alumina, mullite, silicon carbide, silicon nitride, silicon aluminium oxy-nitride, zircon, magnesia, zirconia, graphite, calcium silicate, boron nitride, aluminium titanate, aluminium nitride and titanium diboride.

24. A control pin according to claim 1, wherein the wear-resistant tip is made of a material having a density in the range 1800-3000 $kg/m^3$.

25. A control pin according to claim 1, wherein the wear-resistant tip is made of a material having a density in the range 1900-2500 $kg/m^3$.

26. A control pin according to claim 1, wherein the control pin has a length in the range 200-1000 mm.

27. A control pin according to claim 1, wherein the control pin has a diameter in the range 20-75 mm.

* * * * *